US012654110B2

(12) United States Patent
Jewel

(10) Patent No.: US 12,654,110 B2
(45) Date of Patent: Jun. 16, 2026

(54) TOY SYSTEM

(71) Applicant: Dymond Jewel, Fort Washington, MD (US)

(72) Inventor: Dymond Jewel, Fort Washington, MD (US)

( * ) Notice: Subject to any disclaimer, the term of this patent is extended or adjusted under 35 U.S.C. 154(b) by 87 days.

(21) Appl. No.: 18/495,836

(22) Filed: Oct. 27, 2023

(65) Prior Publication Data

US 2025/0135364 A1 May 1, 2025

(51) Int. Cl.
*A63H 3/28* (2006.01)
*A63H 3/00* (2006.01)

(52) U.S. Cl.
CPC ..... *A63H 3/28* (2013.01); *A63H 3/003* (2013.01); *A63H 2200/00* (2013.01)

(58) Field of Classification Search
CPC ..... A63H 3/28; A63H 3/003; A63H 2200/00
See application file for complete search history.

(56) References Cited

U.S. PATENT DOCUMENTS 3,469,039 A 9/1969 Lee
5,316,516 A 5/1994 Saitoh
5,328,400 A * 7/1994 Bass ..... A63H 3/50 446/268
5,356,326 A 10/1994 Ting
8,277,221 B2 10/2012 Damron et al.
2001/0053651 A1 12/2001 Wright
2006/0286895 A1* 12/2006 Thomson ..... A63H 3/28 446/297
2007/0065792 A1 3/2007 Schubarth
2008/0014565 A1* 1/2008 Raumberger ..... G09B 23/28 434/236
2008/0214089 A1 9/2008 Vermac et al.
2010/0221978 A1* 9/2010 Long ..... G09B 19/00 446/298
2013/0059284 A1* 3/2013 Giedgowd, Jr. ..... A63H 3/36 709/219
2014/0011423 A1* 1/2014 Wong Simmons ..... A63H 3/36 446/142
2017/0326464 A1 11/2017 Osarogiagbon
2018/0161685 A1* 6/2018 Garren ..... G09B 19/00
2020/0372918 A1* 11/2020 Padawer ..... G10L 15/1822
2021/0322889 A1* 10/2021 Lyell ..... A63H 3/28
2025/0025662 A1* 1/2025 Cronin ..... G16H 20/00

FOREIGN PATENT DOCUMENTS

GB 2136188 A 9/1984

* cited by examiner

*Primary Examiner* — James S. McClellan
(74) *Attorney, Agent, or Firm* — Howard University School of Law; Lyssa-Michelle Morris

(57) ABSTRACT

A toy produces pre-recorded computer-readable audible messages which positively affects the mental wellness of a child. A toy produces pre-generated computer-readable audible messages which positively affects the mental wellness of a child. A computer readable set of user data records generate aural assurance messages configured in the housing. In some implementations, the described technologies include an aural assurance system with an electronic storage for storing a plurality of pre-recorded or pre-generated computer readable aural messages, a computer processor connected to the electronic storage, the plurality of buttons, and the speaker.

6 Claims, 3 Drawing Sheets

TOY SYSTEM

FIELD

The present disclosure relates to a toy system, more particularly to a toy for producing pre-recorded/generated computer-readable instructions to biochemically affect the mental wellness of a child.

BACKGROUND

Mental health disorders result in large economic costs to those afflicted, their families, and society as a whole. The effect is being felt everywhere, from business to science, from governments to the arts. According to a U.S. White House report in 2022, among children age 3-17, the most commonly diagnosed mental disorders from 2013 to 2019 were attention-deficit/hyperactivity disorder (ADHD) (9.8 percent), anxiety (9.4 percent), behavioural problems (8.9 percent), and depression (4.4 percent). These disorders often begin in early childhood: approximately one in six U.S. children age 2-8 had a diagnosed mental, behavioural or developmental disorder. Mental health is the leading cause of disability worldwide and, as of 2019, has a societal cost of approximately $2.5 trillion in the U.S. alone. The lack of significant ability to identify and treat neurological conditions affects younger populations, as well, where mental issues such as depression can take a significant toll. Toys have been of some interest to children for the general purpose of entertainment.

U.S. Pat. No. 3,469,039 which discloses a talking doll in which a sound recorder is associated with a similitude, such as a parrot or a doll, in which the speed of the recording medium is changed, before reproducing, in a direction such that the pitch of the reproduced sound more closely approximates the inherent natural pitch of the similitude. GB2136188A which discloses a compact voice actuated audio electronic device, that repeats instantly and automatically short message spoken into it. U.S. Pat. No. 5,316,516 discloses an animated singing toy bird with external stimulus sensor capable of carrying out movement simulating a real bird. U.S. Pat. No. 5,356,326 discloses a shaking toy having a plush figure resembling a monkey supported within a surrounding cage. In response to stimulus, the toy figure swings back and forth in the cage and an accompanying sound is generated within the toy figure.

The age of Big Data is upon us. In the Internet-of-Things era, many digital products can be connected to the Internet. The world contains a vast amount of digital information which is getting ever vaster more rapidly. Though, various toys are available, sadly, there is lacking toys which positively impacts the self-esteem of children, outside of serving the general purpose of entertainment. However, children are more susceptible to outside influences from media, which may result in negative impacts to their self-esteem and development. For example, computer social media use has been medically linked to biological and psychological indicators associated with poor physical health among college students, according to the results of a new study in 2021. According to the study, participants who used social media excessively were found to have higher levels of C-reactive protein (CRP) in blood samples, a biological marker of chronic inflammation that predicts serious illnesses, such as diabetes, certain cancers and cardiovascular disease. In addition to elevated CRP levels, results suggest higher social media use was also related to somatic symptoms, like headaches, chest and back pains, and more frequent visits to doctors and health centers for the treatment of illness.

SUMMARY

In light of the foregoing background, the following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below. Aspects of the described technologies pertain to a toy doll, an activation system, and an audible messaging center.

In some implementations, the described technologies pertain to a toy, including a housing, a plurality of buttons configured in the housing, a physiological neurochemical aural assurance system and a speaker. The system may include one or more hardware processors configured by machine-readable instructions. A computer readable set of user data records generate aural assurance messages configured in the housing. In some implementations, the described technologies include an aural assurance system with an electronic storage for storing a plurality of pre-recorded computer readable aural messages, a computer processor connected to the electronic storage, the plurality of buttons, and the speaker.

In some implementations, the described technologies pertains to processor(s) that may be configured to electronically process to receive a command on activation of at least one of the plurality of buttons, identify the activated button from the first set of buttons and the second set of buttons responsive to the received command, select the pre-recorded or pre-generated computer readable aural message associated with the identified button from the electronic storage; and send a signal/command to the speaker to play the pre-recorded or pre-generated computer readable aural message. The speaker plays the pre-recorded or pre-generated computer readable aural message.

In one aspect, an audible messaging doll may include a computer system that may contain wiring which connects to activation points which is visually concealed by the plush material of the doll. In one aspect, the audible toy doll may include a human-form shape which conceals the electronic components from visual observation.

In one aspect, the doll may include a computer voice box that is activated by contact on the housing shoulder portion which will audible reply with certain short-hand phrases. In another aspect, the audible toy doll may include individual pieces of clothing which may be added to and removed from the doll. In one aspect, the audible toy doll may change design including its hairstyles, and eye color. In aspect of the disclosure provides a toy producing pre-recorded or pre-generated computer-readable audible messages to positively affect the mental wellness of a child. In a further aspect, the toy may allow a user to process the pre-recorded or pre-generated computer-readable audible messages over a communication network.

In some implementations, the described technologies pertain to a system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One aspect may include a toy having a housing; a plurality of buttons configured in the housing, where the plurality of buttons may include a first set of buttons and a second set of buttons; an aural assurance system configured in the housing, the aural assurance system may include: a non-transient computer-readable storage medium having executable instructions embodied thereon for storing a plurality of pre-recorded computer readable aural assurance messages, where the pre-recorded computer readable aural assurance messages may include a first set of pre-recorded computer readable aural messages and a second set of pre-recorded computer readable aural assurance messages, where the first set of pre-recorded computer readable aural assurance message is associated with at least one of the first set of buttons, and the second set of pre-recorded computer readable aural assurance message is associated with at least one of the second set of buttons; a speaker configured to play the plurality of pre-recorded computer readable aural assurance messages.

In some implementations, the described technologies pertain to one or more hardware processors configured with machine readable instructions connected to the non-transient computer-readable storage medium, the plurality of buttons and the speaker, the one or more hardware processors configured to: receive a command on activation of at least one of the plurality of buttons; identify an activated button from the first set of buttons and the second set of buttons responsive to the received command; select the pre-recorded computer readable aural message associated with the identified button from the non-transient computer-readable storage medium; and send a command to the speaker to play the pre-recorded computer readable aural message. Other one or more constructions of this aspect include corresponding computer systems, apparatus, and computer programs recorded on one or more computer storage devices, each configured to perform the actions of the methods.

In some implementations, the described technologies pertain to a toy also including a housing; a plurality of buttons configured in the housing, where the plurality of buttons may include a first set of buttons and a second set of buttons; an aural assurance system configured in the housing, the aural assurance system may include: a non-transient computer-readable storage medium having executable instructions embodied thereon for storing a plurality of pre-generated computer readable aural assurance messages, where the pre-generated computer readable aural assurance messages may include a first set of pre-generated computer readable aural messages and a second set of pre-generated computer readable aural assurance messages, where the first set of pre-generated computer readable aural assurance message is associated with at least one of the first set of buttons, and the second set of pre-generated computer readable aural assurance message is associated with at least one of the second set of buttons; a speaker configured to play the pre-generated computer readable aural assurance message.

In some implementations, the described technologies pertain to one or more hardware processors configured with machine readable instructions connected to the non-transient computer-readable storage medium, the plurality of buttons and the speaker, the one or more hardware processors configured to: receive a command on activation of at least one of the plurality of buttons; identify an activated button from the first set of buttons and the second set of buttons responsive to the received command; select the pre-generated computer readable aural message associated with the identified button from the non-transient computer-readable storage medium; and send a command to the speaker to play the pre-generated computer readable aural message. Other one or more constructions of this aspect include corresponding computer systems, apparatus, and computer programs recorded on one or more computer storage devices, each configured to perform the actions of the methods.

According to one or more constructions of the described technologies, providing aural assurance message can have a biochemical effect on the brain's chemistry, releasing neurotransmitter biochemicals, such as dopamine and serotonin, reducing stress and anxiety, and promoting a positive and motivated state of mind.

Implementations may include one or more of the following features. The toy where the first set of buttons is associated with pre-generated computer readable aural messages with "you" statements. The second set of buttons is associated with pre-generated computer readable aural messages with "I" statements. Implementations of the described techniques may include hardware, a method or process, or computer software on a computer-accessible medium.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

BRIEF DESCRIPTION OF THE DRAWINGS

A detailed description of the present disclosure will be made with reference to the accompanying drawings, where like numerals refer to like parts and in which.

BRIEF DESCRIPTION

Figure 1:
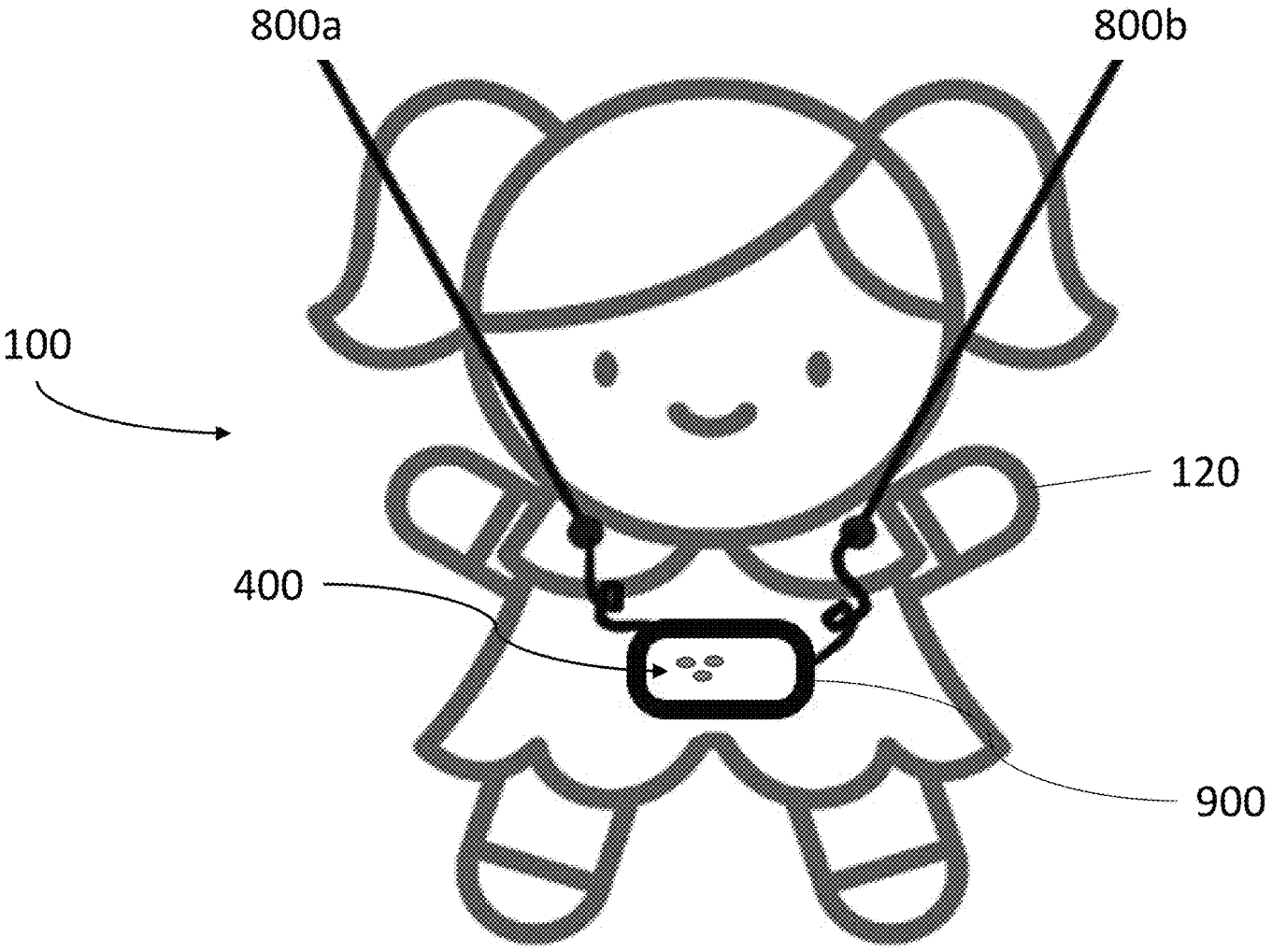
FIG. 1 illustrates a perspective view of a toy according to one possible exemplification which certain aspects of the present disclosure may be implemented.

In the following descriptions of the present disclosure, terms such as "first", "second" and the like are used herein merely for ease of description and refer to the position of the components shown in the figures and are not meant to limit the present disclosure or exemplification in any way.

At the outset, it should be clearly understood that like reference numerals are intended to identify the same components or elements or portions consistently throughout the several drawing figures, as such components, elements or portions may be further described or explained by the entire written specification, of which this detailed description is an integral part. Unless otherwise indicated, the drawings are intended to be read together with the specification, and are to be considered a portion of the entire written description of this present disclosure.

The term 'process' or 'processes' hereinafter refers to a function related to the processor such as editing, downloading, addition, deletion, or uploading of pre-recorded or pre-generated computer-readable aural messages.

According to one or more constructions of the described technologies, the present disclosure of toy 100 employs a concrete practical application of self-affirmation theory that people are motivated to maintain a positive self-view, and that threats to perceived self-competence are met with resistance. When threatened, self-affirmations can restore self-competence by allowing individuals to reflect on sources of self-worth, such as core values. Medical research of the neural mechanisms of self-affirmation for use in a functional magnetic resonance imaging environment has been performed by others. Research in medicine and psychology has improved our understanding of neurological function. According to published research in National Library of Medicine from the National Institute of Health, the results of a region of interest analysis demonstrated that participants who were affirmed, as compared with unaffirmed participants, showed increased activity in key regions of the brain's self-processing (e.g., medial prefrontal cortex and posterior cingulate cortex) and valuation (e.g., ventral striatum and ventral medial prefrontal cortex) systems when reflecting on future-oriented core values compared with everyday activities.

Aspects of the present disclosure relates to a toy 100, such as a doll in one construction. The toy 100 includes a housing, a plurality of buttons configured in the housing, and a physiological neurochemical aural assurance system configured in the housing. The physiological neurochemical aural assurance system includes an electronic storage for storing a plurality of pre-recorded or pre-generated computer readable aural messages, a speaker to play the pre-recorded computer readable aural message, and a processor connected to the electronic storage, the plurality of buttons and the speaker. The disclosure may be described in the context of computer-executable instructions, such as program modules, being executed by a computer processor. Generally, program modules include routines, programs, objects, components, data structures, etc. that perform particular tasks or implement particular computer data types. The disclosure may also be practiced in distributed computing environments where tasks are performed by remote processing devices that are linked through a communications network. In a distributed computing environment, program modules may be located in both local and remote computer storage media including memory storage devices.

Referring to FIG. 1, a toy 100 is shown for producing pre-recorded or pre-generated computer-readable audible assurance messages ("AAM") to positively affect the mental wellness of a child, in accordance with one or more constructions of the present disclosure. The toy 100 includes a housing 120, a plurality of buttons 800 configured in the housing 120, a physiological neurochemical aural assurance system 900 configured in the housing 120, and a speaker 400 configured in the housing 120.

According to one or more constructions of the described technologies, toy 100 provides physiological neurochemical benefits to children to hear positive affirmations for one or more advantages. Positive affirmations can help children develop a sense of pride and belonging in their cultural identity. It can reinforce their connection to their heritage and empower them to embrace their uniqueness.

Positive affirmations from toy 100 can also help children develop a growth mindset. When children hear positive affirmations about their abilities and potential, they are more likely to believe that they can achieve their goals and overcome obstacles. In particular, African American children are often exposed to negative stereotypes and discrimination in society, which can impact their self-esteem and self-worth. Receiving and hearing positive affirmations from toy 100 can counteract these negative messages and help children develop a positive self-image that enhances their connection to their heritage and empower them to embrace their uniqueness. Thus, hearing positive affirmations can have a powerful impact on the development and well-being children, promoting a sense of self-worth, cultural pride, and a growth mindset.

As discussed in the foregoing, scientifically, physiological neurochemical positive affirmations can have an effect on the brain's chemistry. When children hear or repeat positive affirmations from toy 100, it can activate the human brain's reward centers, specifically, the nucleus accumbens and release "feel-good" biochemicals, such as dopamine and serotonin.

Dopamine is a neurotransmitter that is associated with pleasure, reward, and motivation. When children receive positive feedback or hear positive affirmations with toy 100 with aural assurance system 900, it can stimulate the release of dopamine, leading to feelings of pleasure and motivation. This can also increase the attention and focus, making it easier to learn and retain new information.

Serotonin is another neurotransmitter that is associated with mood regulation, happiness, and well-being. Hearing positive affirmations from toy 100 with aural assurance system 900 can stimulate the release of serotonin, leading to feelings of happiness and contentment. This can also reduce stress and anxiety, leading to a more relaxed and calm state of mind.

In addition, positive affirmations can also have an effect on the brain's stress response system. When humans experience stress, the body releases cortisol, which can have negative effects on the brain and body. The human body receiving positive affirmations with toy 100 with aural assurance system 900 can reduce stress levels and lower cortisol levels, leading to a more positive and relaxed state of mind.

According to one or more constructions of the described technologies, toy 100 with aural assurance system 900, provides a plush toy that is designed to produce audible messages of positivity to children. The messages may provide emotional support to individuals of all ages. In one or more constructions, the doll 100 may be equipped with a speaker and a pre-recorded database of positive affirmations, empowering messages, and soothing sounds.

According to one or more constructions of the described technologies, the doll 100, may be in human-form shape, may be activated by pressing a button on its housing shoulder portion (e.g., a plurality of buttons 800), which will trigger the speaker to play the selected affirmation from its database (e.g., electronic storage 300). The affirmations (e.g., AAMs) are designed to boost self-esteem, confidence, and emotional well-being, and will be recorded in a variety of voices, tones, and accents to cater to diverse audiences.

In addition to its audio capabilities, the toy 100 may be also designed with a soft and huggable exterior, making it a comforting companion for children and adults alike. The toy 100 makes a positive impact on the mental health and wellbeing of individuals, especially those who may be struggling with low self-esteem, anxiety, or depression.

The housing 120 is configured in the form of a human body, an animal, a toy or a tales' character. The housing 120 is non-porous and resilient material (e.g., non-porous resilient plastic material), and has a detachable and replaceable cloth. It would be readily apparent to those skilled in the art that various shapes and sizes of the housing 120 may be envisioned without deviating from the scope of the present disclosure.

The toy 100 has a plurality of buttons 800 configured in the housing 120. In one or more constructions, the plurality of buttons 800 includes a first set of buttons 800*a* and a second set of buttons 800*b*. Button 800 can be a push-type button with a spring for activation or touch sensitive design for activation to recognize a finger of human or a stylus.

Figure 2:
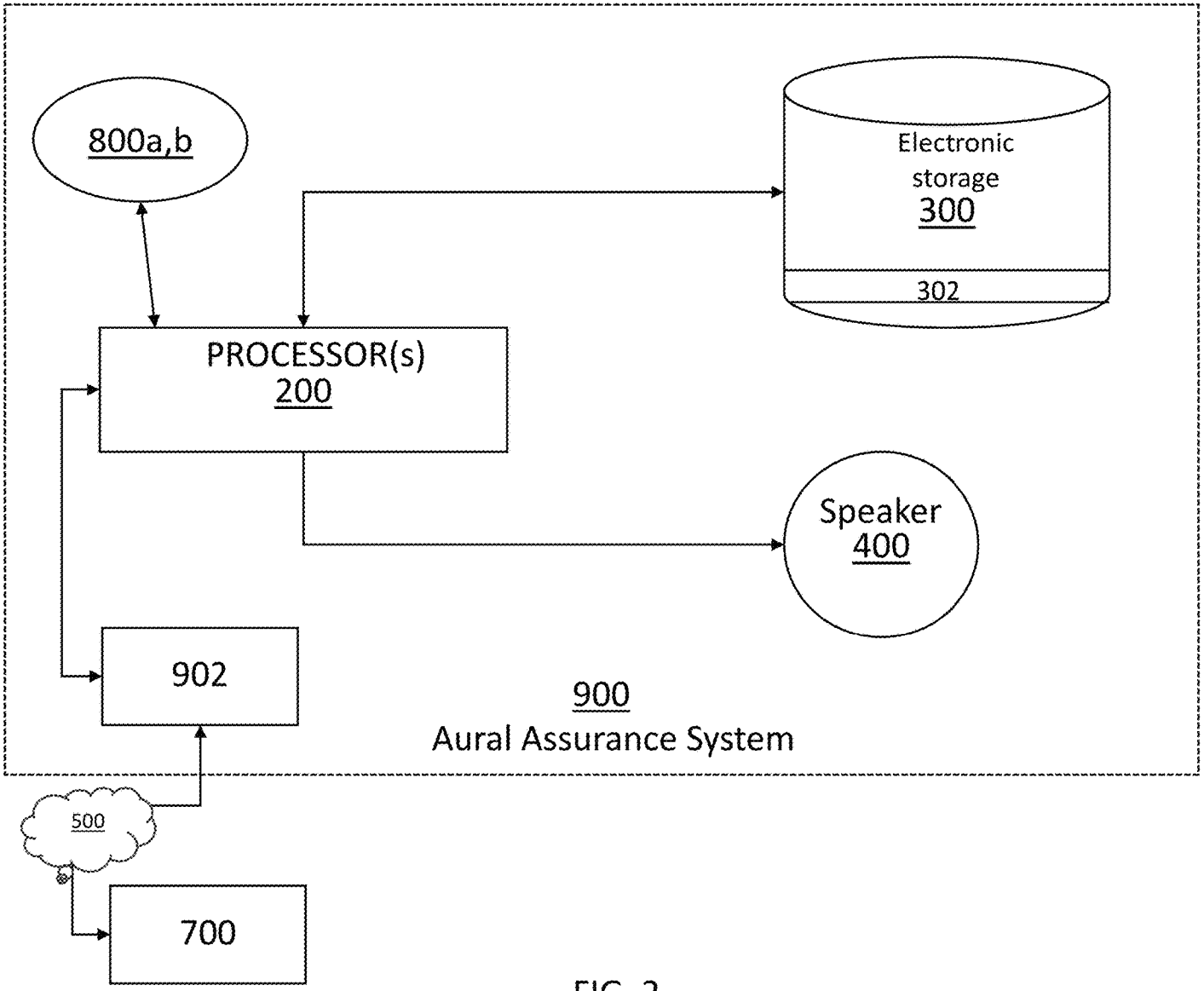
FIG. 2 illustrates a block diagram of aural assurance system which certain aspects of the present disclosure may be implemented.

Referring to FIG. 2, a block diagram of an aural assurance system 900 is shown in accordance with one or more constructions of the present disclosure. The aural assurance system 900 configured in the housing 120 includes a computer readable electronic storage 300, one or more processor (s) 200, and a speaker 400. The processor 200 is connected to the electronic storage 300, the plurality of buttons 800 and the speaker 400.

Figure 3:
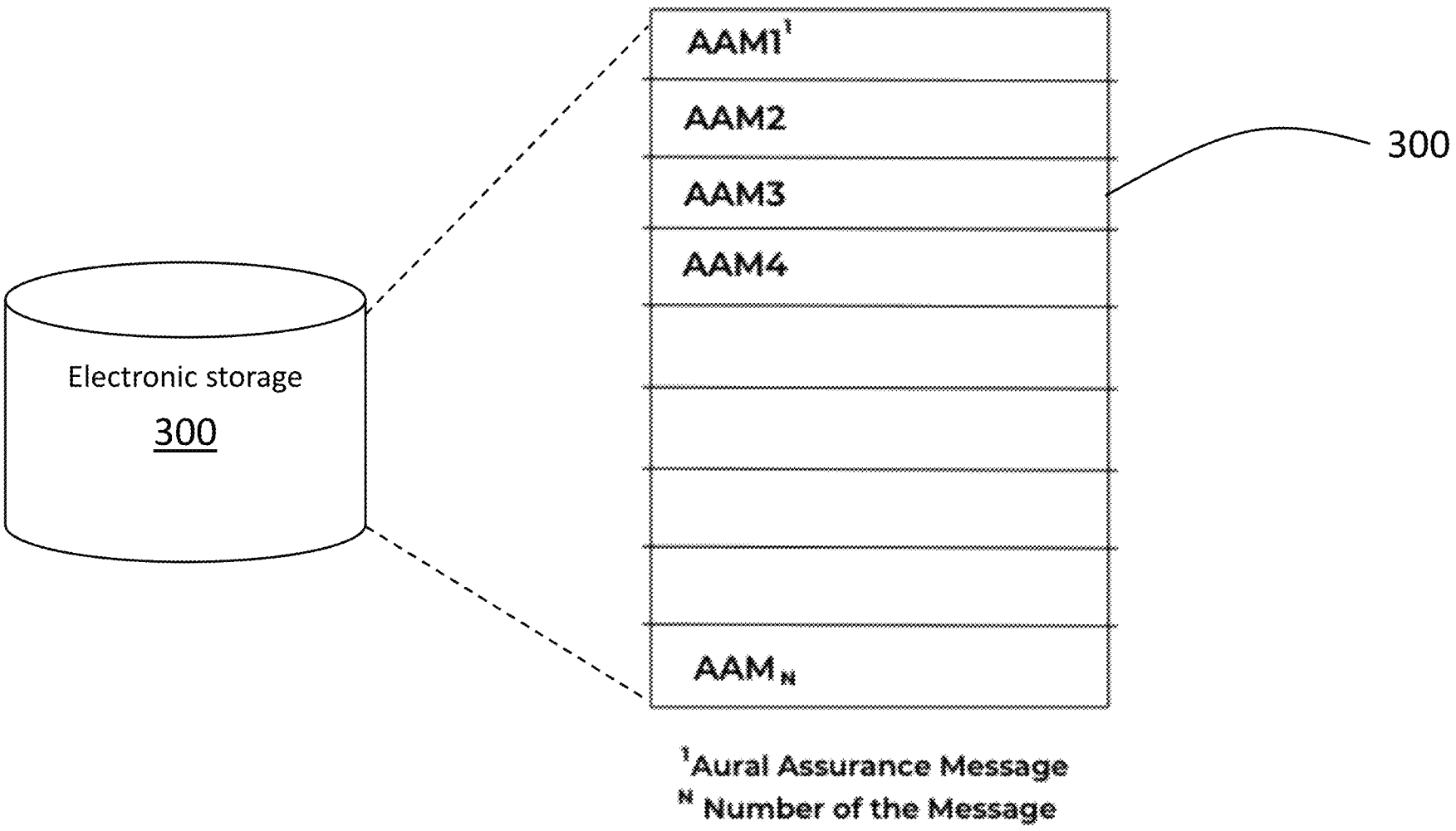
FIG. 3 illustrates a system configured for data processing, in accordance with one or more implementations.

According to one or more constructions of the described technologies, the electronic storage 300 stores a plurality of pre-recorded computer readable aural assurance messages AAM shown in FIG. 3 and Table 1. The pre-recorded computer readable aural assurance messages AAM may include a first set of pre-recorded computer readable aural assurance messages AAMa(n); and a second set of pre-recorded computer readable aural assurance messages AAMb(n), wherein n is an ordinal number. Electronic storage 300 may comprise non-transitory storage media that electronically stores executable instructions embodied data information. The electronic storage media of electronic storage 300 may include one or both of system storage that is provided integrally (i.e., substantially non-removable) with computing processor 200 and/or removable storage that is removably connectable to computing processor 200 via, for example, a port (e.g., a USB port, a firewire port, etc.) or a drive (e.g., a disk drive, etc.). The AAMs may be computer readable mp3, mp4 or other audio formats.

According to one or more constructions of the described technologies, electronic storage 300 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 300 may include one or more virtual storage resources (e.g., cloud storage, a virtual private network, and/or other virtual storage resources). Electronic storage 300 may store software algorithms, information determined by processor(s) 200, information received from communication unit 902, and/or other information that enables toy 100 to function as described herein.

The first set of pre-recorded computer readable aural assurance message AAMa(n) is associated with at least one of the first set of buttons 800*a*, and the second set of pre-recorded computer readable aural assurance message AAMb(n) is associated with at least one of the second set of buttons 800*b*. The speaker 400 is configured to play the pre-recorded computer readable aural assurance messages AAM.

According to one or more constructions of the described technologies, the processor 200 may be configured to receive a command on activation of at least one of the plurality of buttons 800, identify the activated button from the first set of buttons 800*a* and the second set of buttons 800*b*, select the pre-recorded computer readable aural assurance message AAM associated with the identified button 800 from the electronic storage 300, and send a signal/command to the speaker 400 to play the pre-recorded computer readable aural message AAM. Processor(s) 200 may be configured to provide information processing capabilities to toy 100. As such, processor(s) 200 may include one or more digital processors, a digital circuit designed to process information, a circuit designed to process information, a state machine, and/or other mechanisms for electronically processing information. Although processor(s) 200 is shown in FIG. 2 as a single entity, this is for illustrative purposes only. In some implementations, processor(s) 200 may include a plurality of processing units. These processing units may be physically located within the same device, or processor(s) 200 may represent processing functionality of a plurality of devices operating in coordination via network 500.

According to one or more constructions of the described technologies, processor(s) 200 may be configured to execute modules in aural assurance system 900 for and/or other modules by software; hardware; firmware; some combination of software, hardware, and/or firmware; and/or other mechanisms for configuring processing capabilities on processor(s) 200. Processor 200 may be configured by machine-readable instructions. Machine-readable instructions 302 may include one or more instruction modules or engines. The instruction modules may include computer program modules. As used herein, the term "module" may refer to any component or set of components that perform the functionality attributed to the module. This may include one or more physical processors during the execution of processor readable instructions, the processor readable instructions, circuitry, hardware, storage media, or any other components.

According to one or more constructions of the present disclosure, the aural assurance system 900 further includes a communication unit 902. The communication unit 902 is configured with the processor 200 to communicate over a communication network 500. Examples of the communication network include but are not limited any suitable computer network including the Internet, an intranet, a wide-area network (WAN), a local-area network (LAN), a wireless network, a digital subscriber line (DSL) network, a frame relay network, an asynchronous transfer mode (ATM) network, a virtual private network (VPN), or any combination of any of the same.

According to one or more constructions of the described technologies, the processor 200 is configured to electronically process the pre-recorded computer readable aural messages on receiving command from an electronic device 700 via the communication unit 902. Examples of the electronic device 700 include but not limited to a mobile, personal computer, a cloud-based platform, smartphone, and other similar electronic devices capable of sending commands to the processor 200.

According to one or more constructions of the described technologies, the first set of buttons 800*a* is associated with pre-recorded computer readable aural messages AAMa(n) with 'you' statements.

According to one or more constructions of the described technologies, the first set of buttons 800*b* is associated with pre-recorded computer readable aural messages AAMb(n) with 'I' statements.

According to one or more constructions of the described technologies, the electronic storage 300 stores a plurality of pre-generated computer readable aural assurance messages AAM shown in FIG. 3 and Table 1. The pre-generated computer readable aural assurance messages AAM may include a first set of pre-generated computer readable aural assurance messages AAMa(n); and a second set of pre-generated computer readable aural assurance messages AAMb(n), wherein n is an ordinal number. That is, "attribute data" including ASCII characters in computer readable form or binary complied data, such as text phases can be provided into a computer voice box to play a natural language synthetic humanoid voice to speaker 400. The ASCII characters or binary data can be manipulated in the logic executable instructions embodied in electronic storage 300 of toy system 100.

Table 1 of the present disclosure describes pre-recorded computer readable aural messages AAM with 'you' and 'I' statements.

| AAMa(n) | Pre-recorded computer readable aural messages AAM with 'you' statements. | AAMb(n) | Pre-recorded computer readable aural messages AAM with 'I' statements. |
|---|---|---|---|
| AAMa(1) | I love you. | AAMb(1) | I love myself |
| AAMa(2) | You are special. | AAMb(2) | I am special |
| AAMa(3) | You are unique. | AAMb(3) | I am unique! |
| AAMa(4) | Your feelings are important. | AAMb(4) | My feelings are important |
| AAMa(5) | You are creative! | AAMb(5) | I am creative |
| AAMa(6) | You are a friendly person. | AAMb(6) | I am a friendly person |
| AAMa(7) | You are smart. | AAMb(7) | I am smart |
| AAMa(8) | You can learn anything you want to learn. | AAMb(8) | I can learn anything I want |
| AAMa(9) | You have talents and abilities. | AAMb(9) | I have talents and abilities |
| AAMa(10) | You are perfect just the way you are. | AAMb(10) | I am perfect just the way I am. |
| AAMa(11) | You are perfect inside and out. | AAMb(11) | I am perfect inside and out. |
| AAMa(12) | You are beautiful. | AAMb(12) | I am beautiful |
| AAMa(13) | You have so much to be thankful for! | AAMb(13) | I have so much to be thankful for! |
| AAMa(14) | You are a good person. | AAMb(14) | I am a good person |
| AAMa(15) | You are a great friend. | AAMb(15) | I am a great friend. |
| AAMa(16) | You encourage others. | AAMb(16) | I encourage others |
| AAMa(17) | You are lovable. | AAMb(17) | I am loveable |
| AAMa(18) | People care about you. | AAMb(18) | People care about me |
| AAMa(19) | Do what makes you happy! | AAMb(19) | I do what makes me happy |
| AAMa(20) | Speak the truth. | AAMb(20) | I speak the truth |
| AAMa(21) | You are loved. | AAMb(21) | I am loved |
| AAMa(22) | You are worthy of respect. | AAMb(22) | I am worthy of respect |
| AAMa(23) | Show respect to others. | AAMb(23) | I show others respect. |
| AAMa(24) | Treat people the way you want to be treated. | AAMb(24) | I treat people the way I want to be treated |
| AAMa(25) | You are a good listener. | AAMb(25) | I am a good listener |
| AAMa(26) | You are important in your family. | AAMb(26) | I am important in my family |
| AAMa(27) | You belong here. | AAMb(27) | I belong here |
| AAMa(28) | You ask for help when you need it. | AAMb(28) | I ask for help when I need it |
| AAMa(29) | You help others. | AAMb(29) | I help others |
| AAMa(30) | You care about other people! | AAMb(30) | I care about other people! |
| AAMa(31) | You can become whatever you want. | AAMb(31) | I can become whatever I want |
| AAMa(32) | Your dreams can come true. | AAMb(32) | My dreams can come true. |
| AAMa(33) | I believe in you! | AAMb(33) | I believe in myself! |
| AAMa(34) | Be proud of yourself | AAMb(34) | I am proud of myself |
| AAMa(35) | Have fun! | AAMb(35) | I have fun! |
| AAMa(36) | Make good decisions | AAMb(36) | I make good decisions |
| AAMa(37) | Being kind is the right thing to do. | AAMb(37) | I am kind to others |
| AAMa(38) | Be a good example for others to follow | AAMb(38) | I am a good example for others. |
| AAMa(39) | You can if you think you can. | AAMb(39) | I can if I think I can. |
| AAMa(40) | You are loved. | AAMb(40) | 14. I love myself. |
| AAMa(41) | You love learning new things. | AAMb(41) | I love to learn new things. |
| AAMa(42) | You learn something new every day. | AAMb(42) | I learn something new every day. |

-continued

| AAMa(n) | Pre-recorded computer readable aural messages AAM with 'you' statements. | AAMb(n) | Pre-recorded computer readable aural messages AAM with 'I' statements. |
|---|---|---|---|
| AAMa(43) | Ask for help when you need it. | AAMb(43) | I ask for help when I need it. |
| AAMa(44) | Offer help to others when you can. | AAMb(44) | I offer help to others when I can. |
| AAMa(45) | You belong here. | AAMb(45) | I belong here. |
| AAMa(46) | Use your imagination in positive ways. | AAMb(46) | I use my imagination in positive ways |
| AAMa(47) | Imagine the life you want to live. | AAMb(47) | I imagine the life I want to live |
| AAMa(48) | Imagine who you want to become. | AAMb(48) | I imagine who I want to become |
| AAMa(49) | You are important! | AAMb(49) | I am important. |
| AAMa(50) | Believe in yourself! | AAMb(50) | I believe in myself. |
| AAMa(51) | Anything is possible if you really believe it. | AAMb(51) | Anything is possible if I really believe it |
| AAMa(52) | You love to exercise. | AAMb(52) | I love to exercise. |
| AAMa(53) | You love to eat healthy food. | AAMb(53) | I love to eat healthy food. |
| AAMa(54) | Take good care of your body. | AAMb(54) | I take care of my body. |
| AAMa(55) | You do your very best. | AAMb(55) | I do my very best. |
| AAMa(56) | You set goals for yourself and work toward those goals. | AAMb(56) | I set goals for myself and work toward those goals. |
| AAMa(57) | You feel good about yourself! | AAMb(57) | I feel good about myself |
| AAMa(58) | You have emotions. | AAMb(58) | I have feelings. |
| AAMa(59) | You may feel happy, sad, angry, or scared. | AAMb(59) | I may feel happy, sad, angry, or scared. |
| AAMa(60) | You express your feelings in healthy ways. | AAMb(60) | I express my feelings in healthy ways. |
| AAMa(61) | It is okay to make mistakes. | AAMb(61) | I know I will make mistakes. |
| AAMa(62) | You will learn from your mistakes | AAMb(62) | I learn from my mistakes |
| AAMa(63) | Challenge yourself to do better next time. | AAMb(63) | I challenge myself to do better next time. |
| AAMa(64) | Speak up for what you believe in. | AAMb(64) | I stand up for what I believe in. |
| AAMa(65) | You can make the world a better place. | AAMb(65) | I can make the world a better place. |
| AAMa(66) | You wish for love, peace, and joy all over the world! | AAMb(66) | I wish for love, peace and joy all over the world! |
| AAMa(67) | You are powerful! | AAMb(67) | I am powerful. |
| AAMa(68) | You make your own decisions. | AAMb(68) | I make my own decisions. |
| AAMa(69) | You do what feels right for you. | AAMb(69) | I do what feels right for me. |
| AAMa(70) | When you believe in yourself, there's nothing you can't do. | AAMb(70) | When I believe in myself, there's nothing I can't do |
| AAMa(71) | You have a light inside of you. | AAMb(71) | There is a light inside of me. |
| AAMa(72) | You shine bright like a diamond jewel. | AAMb(72) | I shine bright like a diamond jewel. |

Wherein n = numbers

The mental health crisis facing Americans still imposes significant costs to the well-being of affected individuals, their loved ones, and society as a whole. This crisis took hold long before the onset of the COVID-19 pandemic, but its effects were amplified as the pandemic resulted in the loss of lives and livelihoods and unprecedented social isolation. According to one or more aspects of the present disclosure, providing positive aural assurance messages (AAM) by system toy 100 has the ability to counteract perceived negative messages and help children to develop positive self-images by releasing neurotransmitter biochemicals, such as dopamine and serotonin.

While certain embodiments have been described and shown in the accompanying drawings, it is to be understood that such embodiments are merely illustrative of and not restrictive on the broad disclosure, and that the disclosure is not limited to the specific constructions and arrangements shown and described, since various other modifications may occur to those of ordinary skill in the art.

The purpose of the statements about the technical field is generally to enable the US Patent and Trademark Office and the public to determine quickly, from a cursory inspection, the nature of this patent disclosure. The description of the technical field is believed, at the time of the filing of this patent disclosure, to adequately describe the technical field of this patent disclosure. However, the description of the technical field may not be completely applicable to the claims as originally filed in this patent disclosure, as amended during prosecution of this patent disclosure, and as ultimately allowed in any patent issuing from this patent disclosure. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the disclosure, are accurate and are hereby included by reference into this specification.

The background information is believed, at the time of the filing of this patent disclosure, to adequately provide background information for this patent disclosure. However, the background information may not be completely applicable to the claims as originally filed in this patent disclosure, as amended during prosecution of this patent disclosure, and as ultimately allowed in any patent issuing from this patent disclosure. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The summary is believed, at the time of the filing of this patent disclosure, to adequately summarize this patent disclosure. However, portions or all of the information contained in the summary may not be completely applicable to the claims as originally filed in this patent disclosure, as amended during prosecution of this patent disclosure, and as ultimately allowed in any patent issuing from this patent disclosure. Therefore, any statements made relating to the summary are not intended to limit the claims in any manner and should not be interpreted as limiting the claims in any manner.

The details in the patents, patent disclosures and publications may be considered to be incorporable, at applicant's option, into the claims during prosecution as further limitations in the claims to patentably distinguish any amended claims from any applied prior art.

The purpose of the title of this patent disclosure is generally to enable the Patent and Trademark Office and the public to determine quickly, from a cursory inspection, the nature of this patent disclosure. Therefore, the title is not intended to limit the claims in any manner and should not be interpreted as limiting the claims in any manner.

The abstract of the disclosure is submitted herewith as required by 37 C.F.R. section 1.72(b). As stated in 37 C.F.R. section 1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments (may be alternatively used as exemplifications) of the present disclosure described herein above in the context of the preferred embodiments are not to be taken as limiting the embodiments of the present disclosure to all of the provided details thereof, since modifications and variations thereof may be made without departing from the spirit and scope of the embodiments of the present disclosure.

While various aspects and embodiments have been disclosed herein, other aspects and embodiments are contemplated. The various aspects and embodiments disclosed herein are for purposes of illustration and not intended to be limiting. Additionally, the words "including," "having," and variants thereof (e.g., "includes" and "has") as used herein, including the claims, shall be open-ended and have the same meaning as the word "comprising" and variants thereof (e.g., "comprise" and "comprises").

The embodiments of the disclosure as described herein above in the context of the preferred embodiments are not to be taken as limiting the embodiments of the present disclosure to all of the provided details thereof, since modifications and variations thereof may be made without departing from the spirit and scope of the embodiments of the disclosure.

I claim:

1. A toy comprising:

a housing, wherein the housing is in a shape of a body having a first shoulder and a second shoulder;

a plurality of buttons configured in the housing, wherein the plurality of buttons comprises:

a first set of two or more buttons disposed on the first shoulder and associated with a first set of stored computer-readable aural assurance messages with 'you' statements, and a second set of two or more buttons disposed on the second shoulder and associated with a second set of stored computer-readable aural assurance messages with 'I' statements; and an aural assurance system configured in the housing, the aural assurance system comprising:

a non-transient computer-readable storage medium having executable instructions embodied thereon for storing a plurality of computer-readable aural assurance messages, wherein the plurality of computer-readable aural assurance messages comprise:

the first set of stored computer-readable aural assurance messages, and the second set of stored computer-readable aural assurance messages;

a speaker configured to play the plurality of computer-readable aural assurance messages; and one or more hardware processors configured with machine readable instructions and connected to the non-transient computer-readable storage medium, the plurality of buttons, and the speaker, the one or more hardware processors configured to:

receive, based on activation of at least one of the plurality of buttons, a command;

identify, responsive to the received command, an activated button from the first set of two or more buttons and the second set of two or more buttons;

select a computer-readable aural assurance message associated with the activated button; and output, via the speaker, the selected computer-readable aural assurance message.

2. The toy according to claim 1, wherein the housing is in the shape of a human body, an animal body, or a fairy tale character body.

3. The toy according to claim 1, wherein the aural assurance system further comprises a communication unit connected to the one or more hardware processors and configured to communicate over a communication network.

4. The toy according to claim 3, wherein the one or more hardware processors are further configured to:

receiving, from an electronic device and via the communication unit, a second command; and electronically process, based on receiving the second command, the selected computer-readable aural assurance message.

5. The toy according to claim 1, wherein the housing further comprises a non-porous resilient plastic material and has a detachable and replaceable cloth.

6. The toy according to claim 1, wherein the plurality of computer-readable aural assurance messages are pre-recorded or pre-generated.

* * * * *